US007567164B2

(12) United States Patent
Chin

(10) Patent No.: US 7,567,164 B2
(45) Date of Patent: Jul. 28, 2009

(54) TRANSFORMER HAVING REDUCED SIZE, SAFETY INSULATION AND LOW LEAKAGE INDUCTANCE

(75) Inventor: Kwong Kei Chin, Fremont, CA (US)

(73) Assignee: Artesyn Technologies, Inc., Boca Raton, FL (US)

( * ) Notice: Subject to any disclaimer, the term of this patent is extended or adjusted under 35 U.S.C. 154(b) by 519 days.

(21) Appl. No.: 11/218,257

(22) Filed: Sep. 1, 2005

(65) Prior Publication Data

US 2007/0046411 A1 Mar. 1, 2007

(51) Int. Cl.
*H01F 27/30* (2006.01)

(52) U.S. Cl. ..... 336/198

(58) Field of Classification Search ..... 336/65, 336/83, 192, 198, 200, 206–208, 232
See application file for complete search history.

(56) References Cited

U.S. PATENT DOCUMENTS 5,010,314 A 4/1991 Estrov
5,559,487 A * 9/1996 Butcher et al. ..... 336/178
6,522,233 B1 * 2/2003 Kyoso et al. ..... 336/200

* cited by examiner

*Primary Examiner*—Tuyen T. Nguyen
(74) *Attorney, Agent, or Firm*—K&L Gates LLP

(57) ABSTRACT

A transformer. The transformer includes a first conductor plate, a second conductor plate, a plate positioning member, an insulated wire, and a magnetic core. The second conductor plate is spaced apart from and electrically connected to the first conductor plate. The plate positioning member is in contact with and surrounded by the first and second conductor plates. The insulated wire is wound around the plate positioning member and between the first and second conductor plates. The magnetic core includes a portion surrounded by the plate positioning member, the first conductor plate, the second conductor plate, and the insulated wire.

18 Claims, 18 Drawing Sheets

TRANSFORMER HAVING REDUCED SIZE, SAFETY INSULATION AND LOW LEAKAGE INDUCTANCE

BACKGROUND OF INVENTION

This application discloses an invention that is related, generally and in various embodiments, to a transformer with reduced size, safety insulation and low leakage inductance. Power supplies are becoming more compact to keep pace with the reduction in size of the equipment they provide energy for. The power processing components, including the main transformer, comprise a significant portion of the power supply's volume, and the heat the components dissipate requires bulky cooling apparatus such as heatsinks and fans. By reducing the power loss of the power supply, the size of the cooling apparatus can be reduced, and components like the main transformer are a key target for reducing the power loss of the power supply.

Power supply transformers provide the isolation barrier between the high AC input voltage and the low DC output voltages, which may be contacted by personnel, so safety rated insulation is required in each transformer. To meet the mandates of various safety agencies, a power transformer must include either defined spacings between conductors or have multiple layers of insulation separating the conductors. These spacing requirements add to the size of power transformers and increase leakage inductance, which interferes with the rapid transfer of energy from the primary to the secondary of the transformer. For example, Operating at a high frequency is a desirable way to reduce transformer size. However, leakage inductance is particularly problematic as switching frequency increases. Although dividing the windings into multiple sections and interleaving the primary and the secondary reduces leakage inductance, the multiple sections require additional layers of insulation and make manufacture of such transformers difficult and expensive. In addition, because significant power transfer at a low output voltage leads to a high output current, the secondary winding cross-section must be relatively large.

A well-known solution for some of these problems is the planar transformer, which employs multi-layer printed circuit technology to create an interleaved winding structure. However, as the technology is limited to thin copper sheet, many layers are needed to achieve significant conductor cross-section. Accordingly, planar transformers often have 12, 16 or more layers of conductor and associated insulating laminate. Unfortunately, the multiple layers of insulation block heat transfer, reduce volumetric efficiency and increase cost.

SUMMARY

In one general respect, this application discloses a transformer. According to various embodiments, the transformer includes a first conductor plate, a second conductor plate, a plate positioning member, an insulated wire, and a magnetic core. The second conductor plate is spaced apart from and electrically connected to the first conductor plate. The plate positioning member is in contact with and surrounded by the first and second conductor plates. The insulated wire is wound around the plate positioning member and between the first and second conductor plates. The magnetic core includes a portion surrounded by the plate positioning member, the first conductor plate, the second conductor plate, and the insulated wire.

According to various embodiments, the transformer includes a plurality of electrically connected conductor plates, a plate positioning member, an insulated wire, and a magnetic core. The plate positioning member is in contact with and surrounded by the plurality of conductor plates. The insulated wire is wound around the plate positioning member and between each adjacent pair of conductor plates. The magnetic core includes a portion surrounded by the plate positioning member, the plurality of conductor plates, and the insulated wire.

In another general respect, this application discloses a device. According to various embodiments, the device includes a printed circuit board and a transformer. The transformer is connected to the printed circuit board and includes at least two electrically connected conductor plates, a plate positioning member, an insulated wire, and a magnetic core. The plate positioning member is in contact with and surrounded by the at least two conductor plates. The insulated wire is wound around the plate positioning member and between an adjacent pair of the at least two conductor plates. The magnetic core includes a portion surrounded by the plate positioning member, the at least two conductor plates, and the insulated wire.

DETAILED DESCRIPTION OF THE INVENTION

It is to be understood that the figures and descriptions of the disclosed invention have been simplified to illustrate elements that are relevant for a clear understanding of the invention, while eliminating, for purposes of clarity, other elements. Those of ordinary skill in the art will recognize, however, that these and other elements may be desirable. However, because such elements are well known in the art, and because they do not facilitate a better understanding of the invention, a discussion of such elements is not provided herein.

Figure 1:
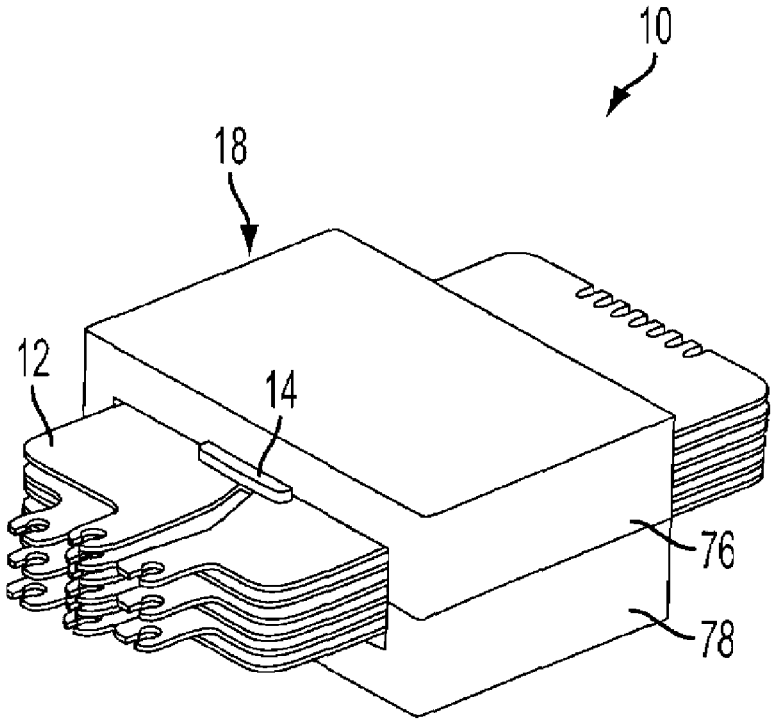
FIGS. 1 and 2 illustrate various embodiments of a transformer.
Figure 2:
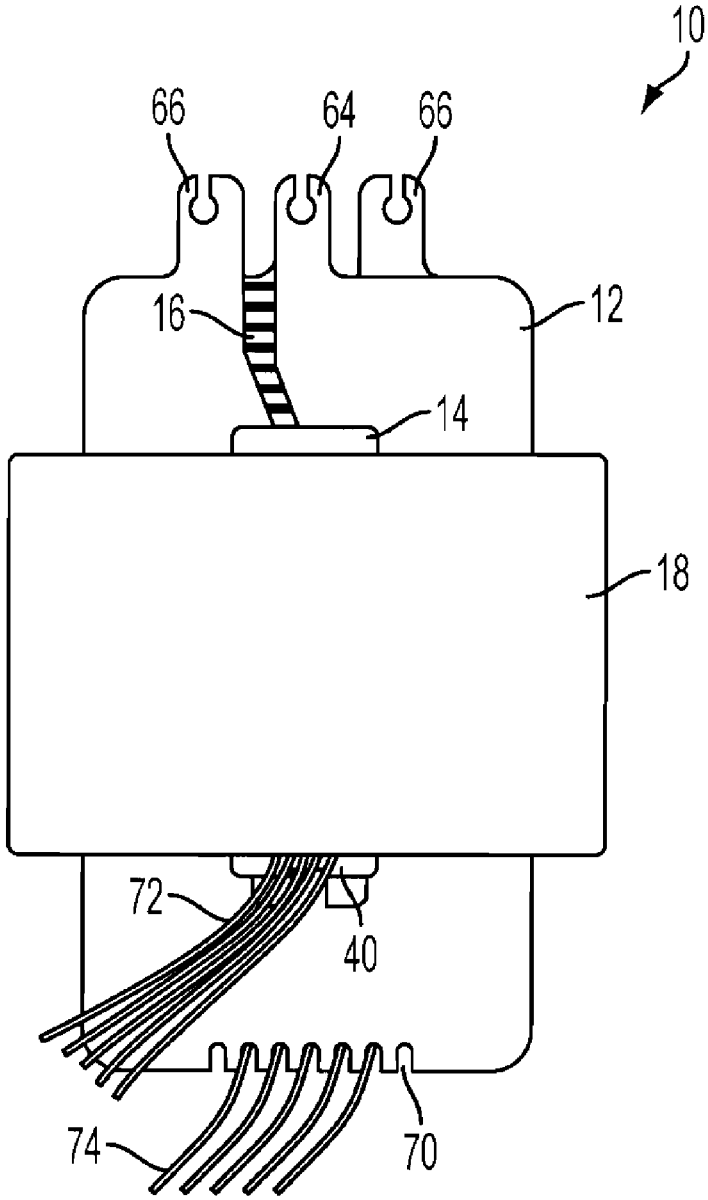

FIGS. 1 and 2 illustrate various embodiments of a transformer 10. The transformer 10 includes at least two conductor plates 12, a plate positioning member 14, an insulated wire 16 (see FIG. 2), and a magnetic core 18. The transformer 10 may be utilized, for example, as an isolation transformer in a switching power supply where the isolation transformer is required to provide reinforced insulation between the primary and secondary of the transformer in accordance with various safety agency standards. For purposes of clarity, the insulated wire 16 is not shown in FIG. 1. According to various embodiments, the transformer 10 may be embodied as a step-down transformer where the primary winding has a greater number of turns than the secondary winding does.

FIGS. 3-6 illustrate various embodiments of the plate positioning member 14 of the transformer 10 of FIG. 1. The plate positioning member 14 is a bobbin-like structure that serves to permit positioning and securing of the conductor plates 12 without employing a support or insulating structure that extends between the conductor plates 12. The plate positioning member 14 may be fabricated from any suitable insulating material such as, for example, a plastic, and may be molded to have features to engage corresponding features on the conductor plates 12. The plate positioning member 14 includes a wall 20 that includes a closed end portion 22, a first side portion 24, a second side portion 26, a first return portion 28 and a second return portion 30.

Figure 3:
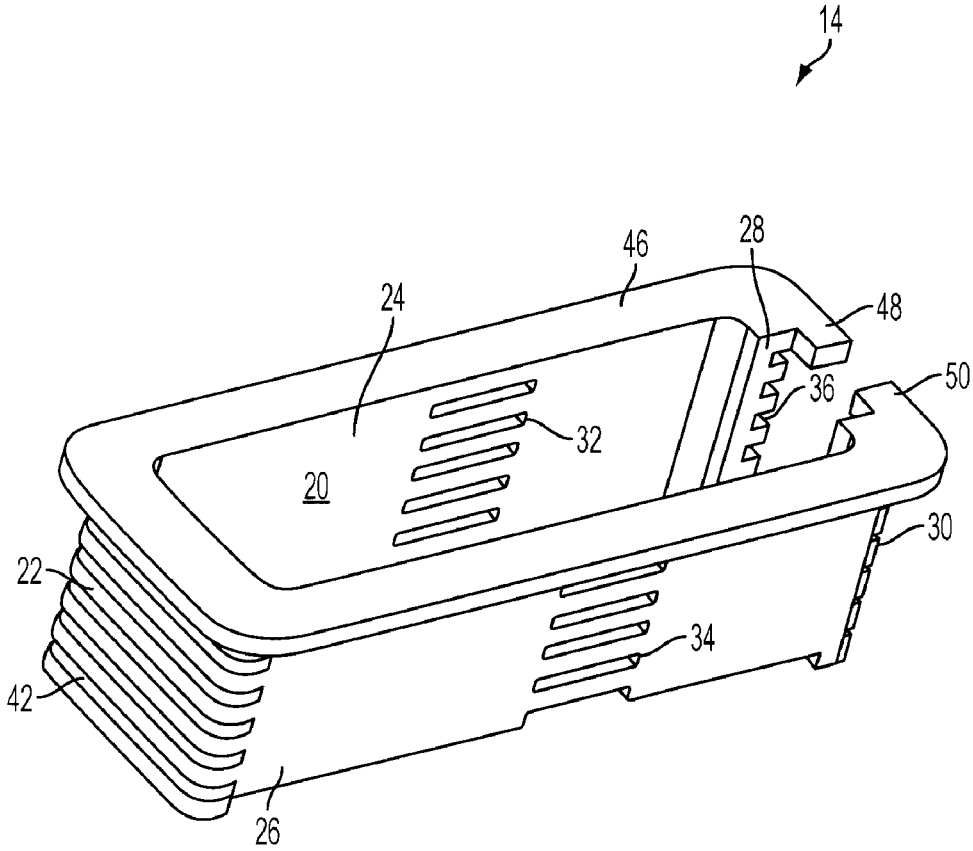
FIGS. 3-6 illustrate various embodiments of a plate positioning member.

The first side portion 24 is connected to the closed end portion 22 and defines a first slit 32. As shown in FIG. 3, the first slit 32 may be a longitudinal slit having a height and width associated therewith. The first side portion 24 may define any number of first slits 32. Each of the first slits 32 pass through the first side portion 24 and are positioned parallel to one another.

The second side portion 26 is connected to the closed end portion 22 and defines a second slit 34. As shown in FIG. 3, the second slit 34 may be a longitudinal slit having a height and width associated therewith. The second side portion 26 is opposite the first side portion 24 and may define any number of second slits 34. Each of the second slits 34 pass through the second side portion 26 and are positioned parallel to one another. Each of the second slits 34 may be parallel to each of the first slits 32. According to various embodiments, each second slit 34 is aligned with a corresponding first slit 32.

Figure 4:
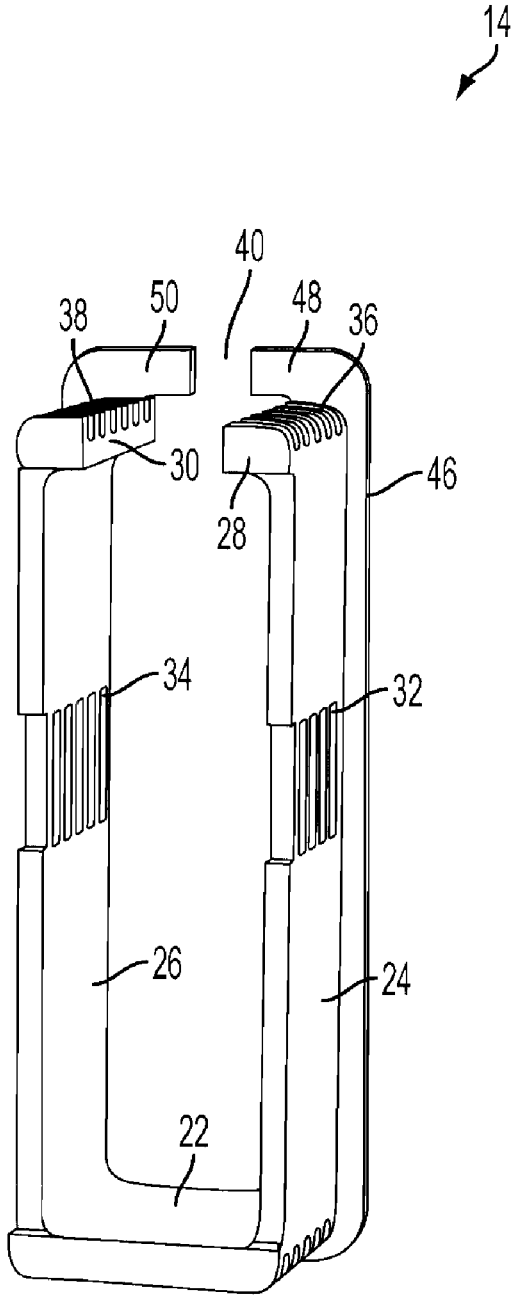

The first return portion 28 is connected to the first side portion 24 and defines a first groove 36. As shown in FIG. 4, the first groove 36 may be a transverse groove having a height and depth associated therewith. The first groove 36 is oriented perpendicular to the first and second slits 32, 34. The first return portion 28 is opposite the closed end portion 22 and may define any number of first grooves 36. Each of the first grooves 36 are positioned parallel to one another. According to various embodiments, each of the first grooves 36 may be aligned with a corresponding first slit 32, a corresponding second slit 34, or a combination thereof.

Figure 5:
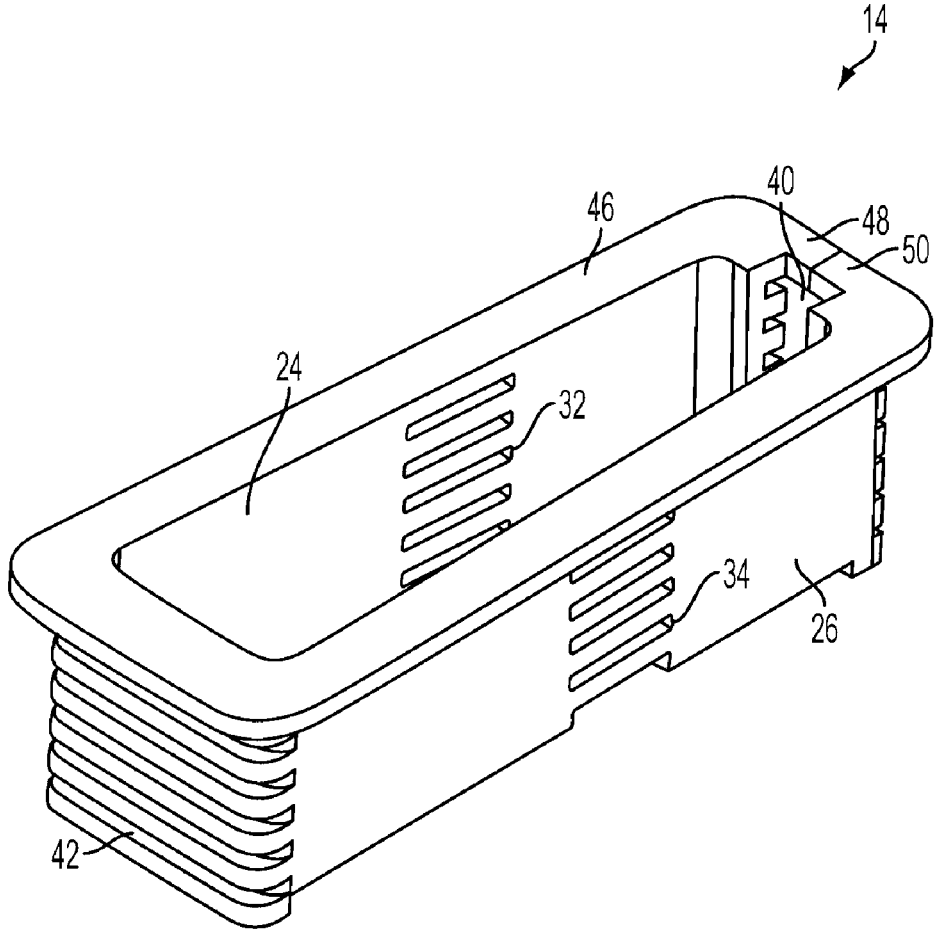

The second return portion 30 is connected to the second side portion 26 and defines a second groove 38 (see FIG. 4). The second return portion 30 is opposite the closed end portion 22 and parallel to the first return portion 28. As shown in FIG. 4, the second groove 38 may be a transverse groove having a height and depth associated therewith. The second groove 38 is oriented parallel to the first groove 36 and perpendicular to the first and second slits 32, 34. The second return portion 30 may define any number of second grooves 38. Each of the second grooves 38 are positioned parallel to one another. According to various embodiments, each of the second grooves 38 may be aligned with a corresponding first slit 32, a corresponding second slit 34, a corresponding first groove 36, or any combination thereof. The first and second return portions 28, 30 define a spacing 40 (see FIG. 4) therebetween that breaks the continuity of the wall 20 of the plate positioning member 14 and permits the plate positioning member 14 to be compressed. As shown in FIG. 5, the spacing 40 can be temporarily decreased by applying a force that causes the first and second return portions 28, 30 to temporarily move toward one another.

The closed end portion 22 is opposite and parallel to the first and second return portions 28, 30. The closed end portion 22 defines a third groove 42. As shown in FIG. 3, the third groove 42 may be a transverse groove having a height and depth associated therewith. The third groove 42 is oriented parallel to the first and second grooves 36, 38 and perpendicular to the first and second slits 32, 34. The closed end portion 22 may define any number of third grooves 42. Each of the third grooves 42 are positioned parallel to one another. According to various embodiments, each of the third grooves 42 may be aligned with a corresponding first slit 32, a corresponding second slit 34, a corresponding first groove 36, a corresponding second groove 38, or any combination thereof.

Figure 6:
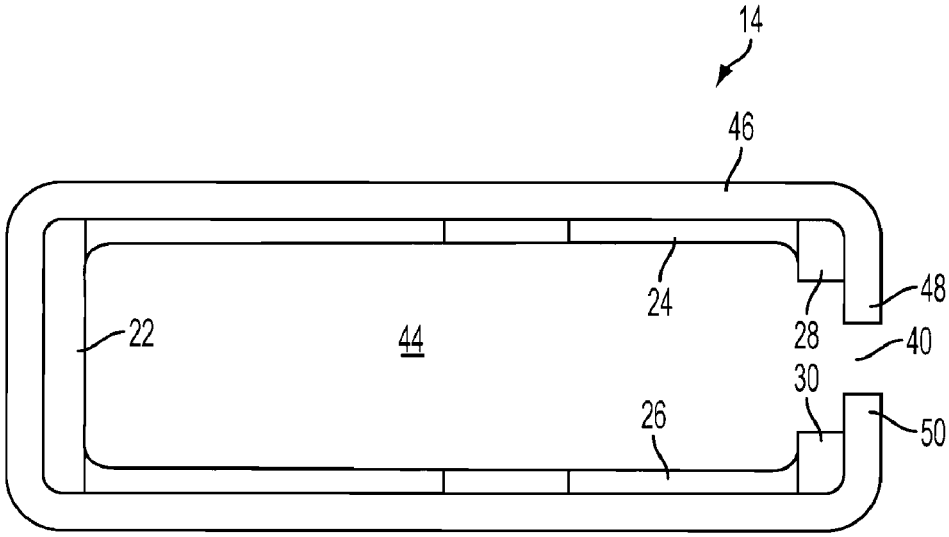

As shown in FIG. 6, the closed end portion 22, the first side portion 24, the second side portion 26, the first return portion 28, and the second return portion 30 collectively define a generally rectangular-shaped opening 44 sized to receive a portion of the magnetic core 18 therethrough. As shown in FIG. 6, a length of the opening 44 is defined by the closed end portion 22 and the first and second return portions 28, 30, and a width of the opening 44 is defined by the first and second side portions 24, 26.

The plate positioning member 14 may further include a flange 46 connected to or integral with the wall 20. According to various embodiments, the flange 46 may be connected to the closed end portion 22, the first side portion 24, the second side portion 26, the first return portion 28, the second return portion 30, or any combination thereof. As shown in FIG. 6, the flange 46 may extend away from each of the portions 22-30 and away from the opening 44. The plate positioning member 14 may further include a first stop 48 that is connected to or integral with the flange 46 proximate the first return portion 28 and extends toward the second return portion 30. The plate positioning member 14 may further include a second stop 50 that is connected to or integral with the flange 46 proximate the second return portion 30 and extends toward the first return portion 28. The first and second stops 48, 50 may cooperate to maintain a minimum distance between the first and second return portions 28, 30 when the first and second return portions 28, 30 are temporarily moved toward one another.

Figure 7:
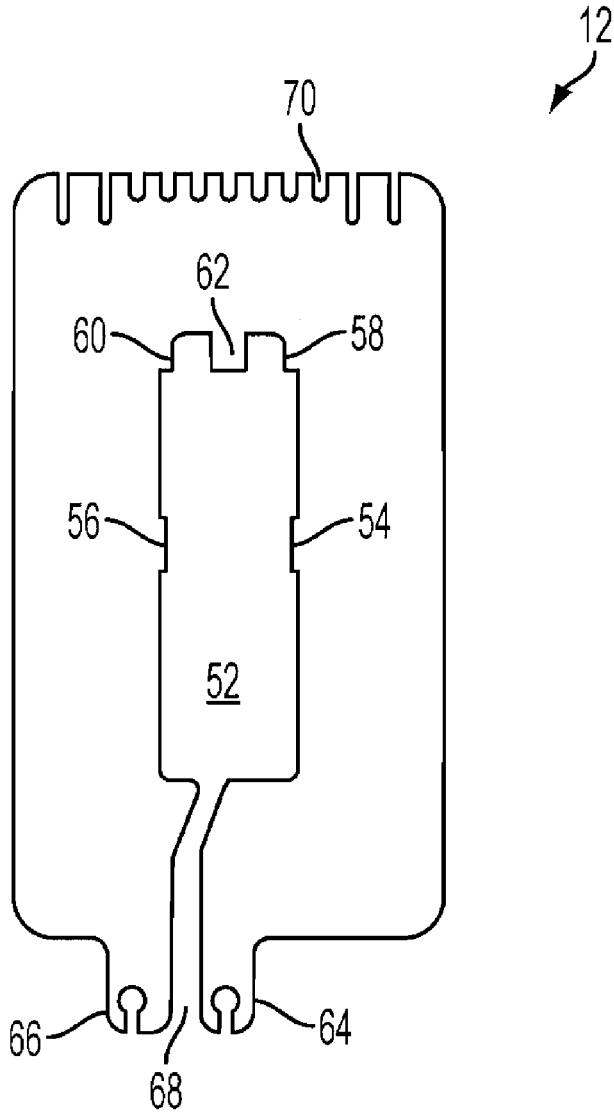
FIG. 7 illustrates various embodiments of a conductor plate.
Figure 8:
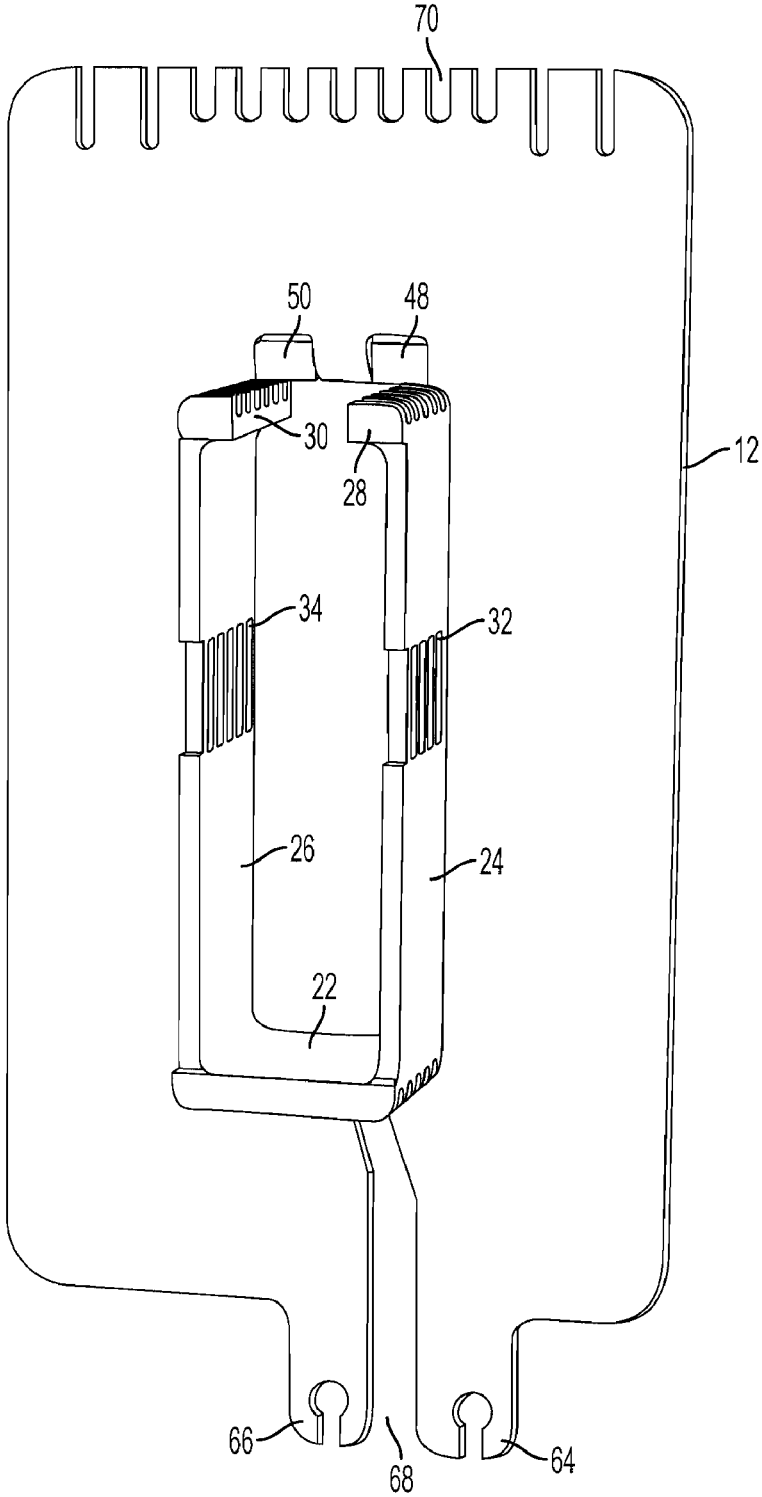
FIG. 8 illustrates various embodiments of a conductor plate connected to a plate positioning member.

FIG. 7 illustrates various embodiments of the conductor plates 12 of the transformer 10 of FIG. 1. Each conductor plate 12 may be formed by a simple stamping process, and defines a generally rectangular-shaped opening 52 that is sized to surround the plate positioning member 14 when the conductor plate 12 is connected to the plate positioning member 14 as shown in FIG. 8. The conductor plate 12 may also define a first tab 54 that borders the opening 52, and a second tab 56 that borders the opening 52 opposite the first tab 54. The plate positioning member 14 may be compressed to facilitate the connection of the conductor plates 12 thereto. When all of the conductor plates 12 are connected to the plate positioning member 14, the compression of the plate positioning member 14 is released and the conductor plates 12 are spaced apart a predetermined distance from one another. When each conductor plate 12 is connected to the plate positioning member 14, the first tab 54 of the respective conductor plate 12 is engaged with a first slit 32 and the second tab 56 of the respective conductor plate 12 is engaged with a second slit 34. According to various embodiments, the conductor plate 12 may define the first tab 54 but not the second tab 56, or may define the second tab 56 but not the first tab 54. For such embodiments, only one of the respective tabs 54, 56 is engaged with one of the respective slits 32, 34 when the conductor plate 12 is connected to the plate positioning member 14.

The conductor plate 12 may also define a first indent 58 that borders the opening 52, and a second indent 60 that borders the opening 52 opposite the first indent 58. When each conductor plate 12 is connected to the plate positioning member 14, the first indent 58 of the respective conductor plate 12 is engaged with a first groove 36 and the second indent 60 of the respective conductor plate 12 is engaged with the second groove 38.

The conductor plate 12 may further define a third indent 62 that borders the opening 52 between the first and second indents 58, 60. When each conductor plate 12 is connected to the plate positioning member 14, the third indent 58 of the respective conductor plate 12 is in contact with the plate positioning member 14 proximate the first and second return portions 28, 30 and may serve to maintain the spacing 40 between the first and second return portions 28, 30. Each conductor plate 12 forms a single turn around the magnetic core 18, and the ends of the turn define a first termination point 64, a second termination point 66, and a gap 68 therebetween. The conductor plate 12 may also define a plurality of wiring slots 70 opposite the first and second termination points 64, 66.

The conductor plates 12 may be electrically interconnected in series and/or in parallel to form in aggregate a large cross-section conductor that serves as the secondary winding of the transformer 10. For each conductor plate 12, the first termination point 64 is aligned with a centerline of the opening 52 and the second termination point 66 is offset from the centerline of the opening 52.

During the operation of the transformer 10, voltage is induced in the conductor plates 12 by the changing flux in the magnetic core 18. As shown in FIGS. 1 and 2, one or more conductor plates 12 may be connected to the plate positioning member 14 in an inverted manner to form a turn in the opposite winding direction. For such arrangements, when the first termination points 64 of the conductor plates 12 are electrically interconnected, the induced voltage at the second termination points 66 of the inverted conductor plates 12 will be opposed in phase to the voltage induced at the second termination points 66 of the non-inverted conductor plates 12.

Figure 9:
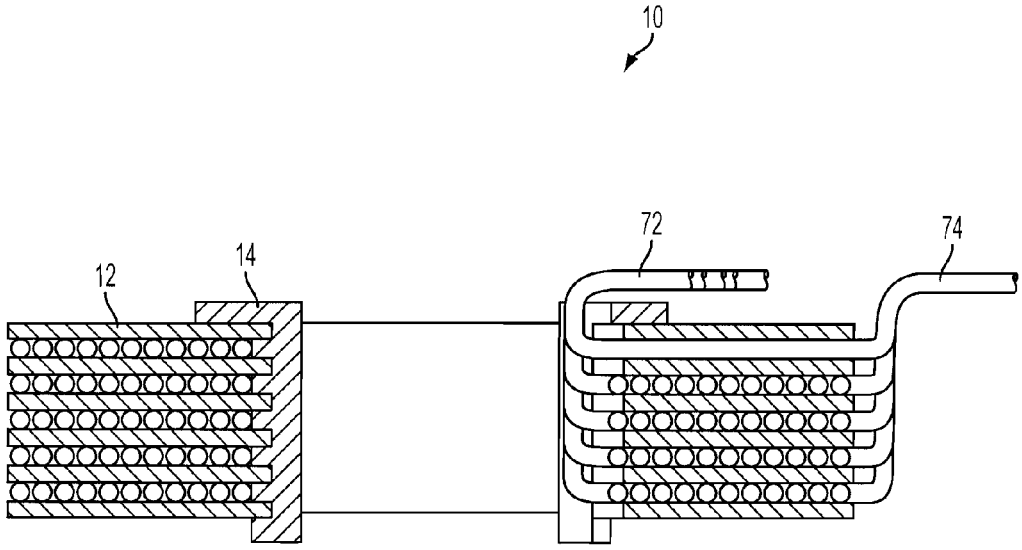
FIG. 9 illustrates the positioning of insulated wire of the transformer of FIGS. 1 and 2 according to various embodiments.

FIG. 9 illustrates the positioning of the insulated wire 16 according to various embodiments. The insulated wire 16 is wound around the plate positioning member 14 and between a pair of adjacent conductor plates 12 to form a winding. The first slit 32, the second slit 34, the first groove 36, the second groove 38 and the third groove 42, or any combination thereof, may cooperate with the conductor plate 12 to secure the position of the conductor plates 12 during the winding of the insulating wire 16. The insulated wire 16 includes a first end 72 and a second end 74, may be in contact with the conductor plates 12, and may include at least two layers of thin insulation. The proper type of wire insulation may be selected depending on the safety isolation requirement. For example, a triple-insulated wire may be used if reinforced insulation is required between the wire 16 and the conductor plates 12. According to various embodiments, a plurality of insulated wires 16 are wound around the plate positioning member 14 and between respective pairs of adjacent conductor plates 12 to form a plurality of windings. The windings may be wound sequentially or at the same time. The respective first ends 72 of the insulated wires 16 may enter through the spacing 40 between the first and second return portions 28, 30 of the wall 20, and the respective second ends 74 of the insulated wires 16 may exit at the wiring slots 70 of the conductor plates 12 as shown in FIG. 2. Although FIG. 9 illustrates five windings interposed between six conductor plates 12, it is understood that any number of conductor plates 12 and windings may be utilized. The windings may be terminated at a safety clearance from the conductor plates 12, and the windings may be interconnected in series and/or in parallel to form a complete primary winding of the transformer 10. The conductor plates 12 and the interposed insulated wires 16 form a closely coupled, interleaved structure that minimizes leakage inductance and permits high frequency operation. Collectively, the insulated wires 16, the plate positioning member 14 and the conductor plates 12 form a coil assembly.

As shown in FIG. 1, the magnetic core 18 may comprise a first E-shaped magnetic core 76 a second E-shaped magnetic core 78. Each of the first and second E-shaped magnetic cores 76, 78 may include a generally rectangular-shaped center leg. The generally rectangular-shaped center legs of the first and second E-shaped magnetic cores 76, 78 are surrounded by the plate positioning member 14, the conductor plates 12, and the insulated wire 16. The first slit 32, the second slit 34, the first groove 36, the second groove 38 and the third groove 42, or any combination thereof, may cooperate with the conductor plate 12 to secure the position of the conductor plates 12 during the insertion of the magnetic core 18 into the coil assembly.

Once the magnetic core 18 is inserted into the coil assembly, the plate positioning member 14 can no longer be compressed and the conductor plates 12 are locked in place. The transformer 10 has a plurality of interleaved sections and the leakage inductance will decrease proportional to the square of the number of sections. Therefore, the five section coil illustrated in FIG. 9 will have one twenty-fifth the leakage inductance of a comparable transformer having a single secondary wound over a single primary. The interleaving is accomplished without excessive reinforced insulation, and the secondary cross-section of the combined conductor plates 12 is large enough to safely handle high output currents.

The transformer 10 may also include other features such as, for example, a terminal header (not shown) in contact with a conductor plate 12 and the plate positioning member 14. The terminal header may include termination pins and may be designed to keep primary terminations at the required creepage distance from the conductive plates 12 and the magnetic core 18. The terminal header may be fabricated from any suitable insulating material such as, for example, a plastic, and may be molded to have features to engage corresponding features on the plate positioning member 14. The corresponding features on plate positioning member 14 may serve to support and/or lock the terminal header in place.

Figure 10:
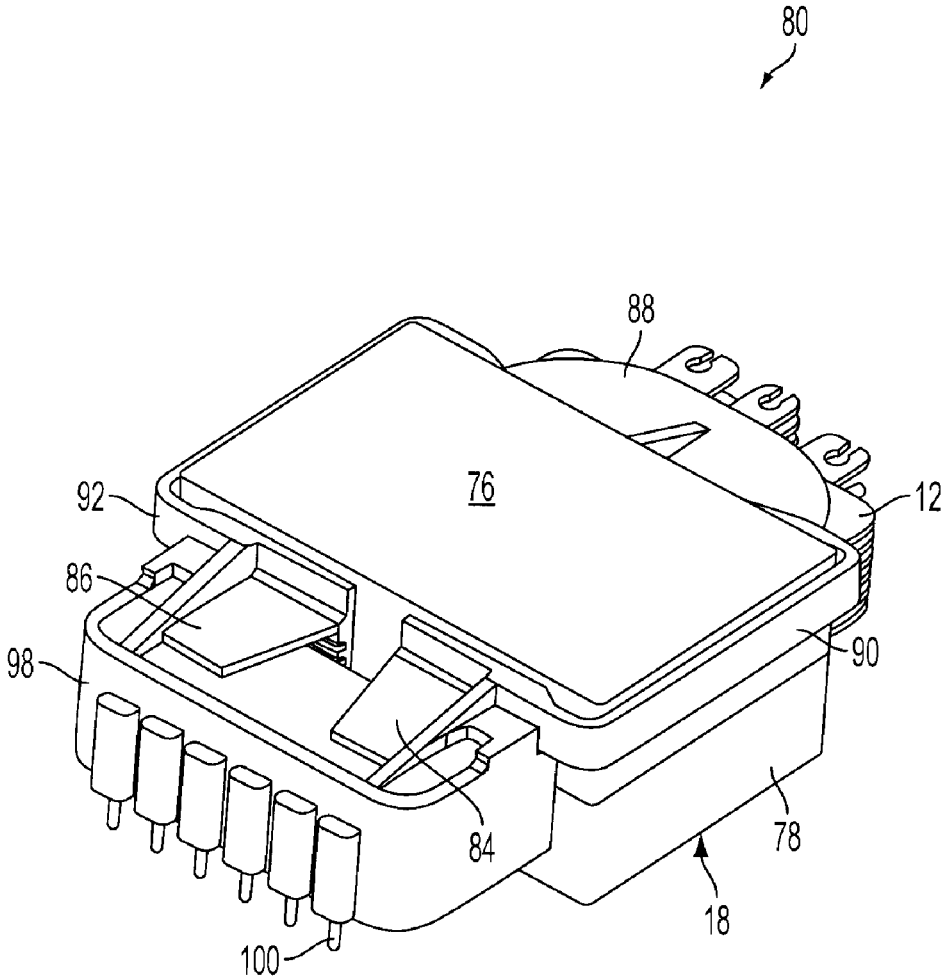
FIGS. 10 and 11 illustrate various embodiments of a transformer.
Figure 11:
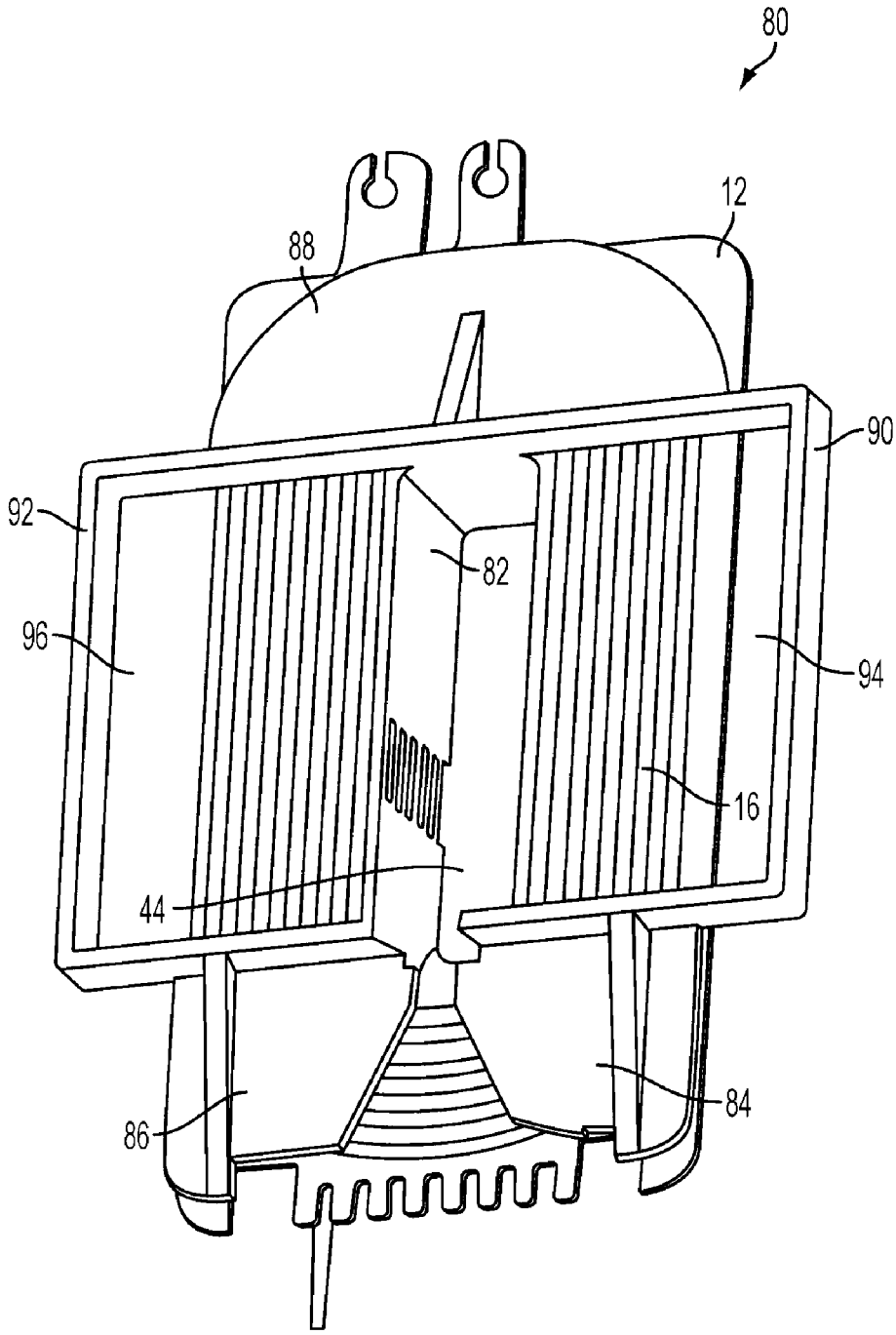
Figure 12:
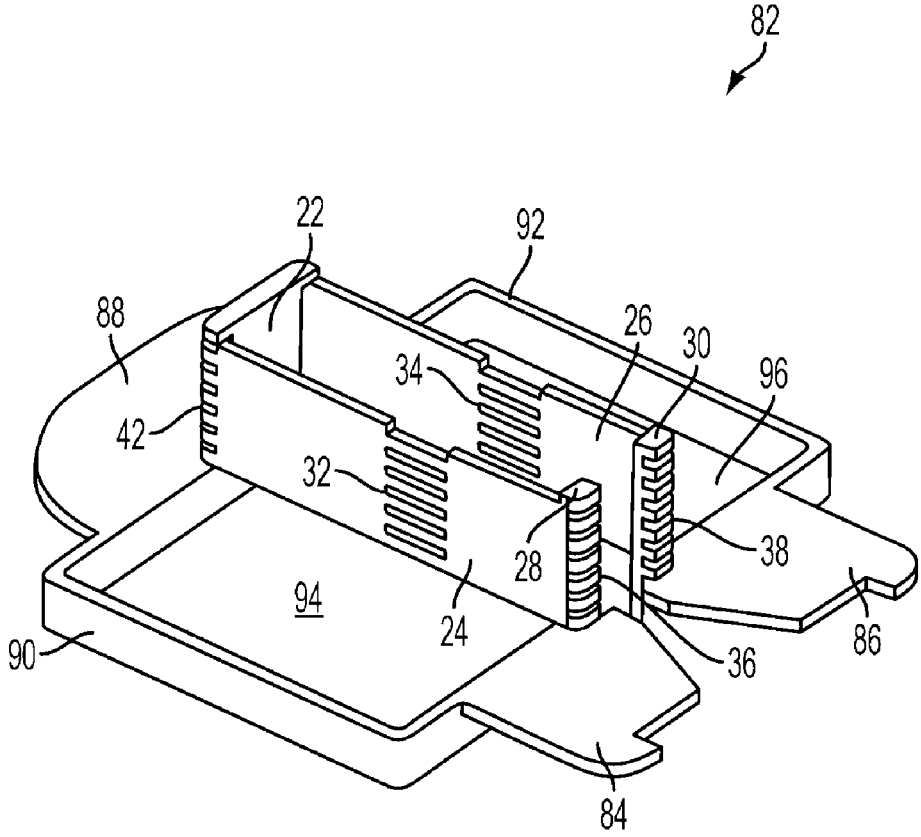
FIG. 12 illustrates various embodiments of a plate positioning member.

FIGS. 10 and 11 illustrate various embodiments of a transformer 80. The transformer 80 is similar to the transformer 10, but includes a plate positioning member 82 that is different than plate positioning member 14. For purposes of clarity, the insulated wiring 16 is not shown in FIG. 10. The plate positioning member 82 does not include the flange 46 described hereinabove and may not include the first and second stops 48, 50 described hereinabove. According to various embodiments, the plate positioning member 82, shown separately in FIG. 12, includes a first flange 84, a second flange 86, and a third flange 88 connected to or integral with the wall 20 of the plate positioning member 82. In addition to being configured to allow for the insulating wire 16 to be wound around the plate positioning member 82 and between an adjacent pair of conductor plates 12, the transformer 80 is also configured to allow for the insulating wire 16 to be wound around the plate positioning member 82 and between a conductor plate 12 and the flanges 84-88 of the plate positioning member 82 as shown in FIG. 11.

The first flange 84 is connected to the first return portion 28 and extends away from the opening 44. The second flange 86 is connected to the second return portion 30 and extends away from the opening 44. The third flange 88 is connected to the closed end portion 22 and extends away from the opening 44. According to various embodiments, the plate positioning member 82 may further include a first wing 90 and a second wing 92. The first wing 90 is connected to or integral with the first and third flanges 84, 88, and the second wing 92 is connected to or integral with the second and third flanges 86, 88. The first wing 90 defines an opening 94 sized to receive a first outer leg of the magnetic core 18 therethrough, and the second wing 92 defines an opening 96 sized to receive a second outer leg of the magnetic core 18 therethrough. The first and second wings 90, 92 provide support for the respective flanges 84-88 of the plate positioning member 82.

As shown in FIG. 10, the transformer 80 also includes a terminal header 98 that includes termination pins 100. The terminal header 98 may be in contact with the conductor plate 12 and the plate positioning member 82. The terminal header 98 may be designed to keep primary terminations at the required creepage distance from the conductive plates 12 and the magnetic core 18. The terminal header may be fabricated from any suitable insulating material such as, for example, a plastic, and may be molded to have features to engage corresponding features on the plate positioning member 82. The corresponding features on plate positioning member 82 may serve to support and/or lock the terminal header in place.

Figure 13:
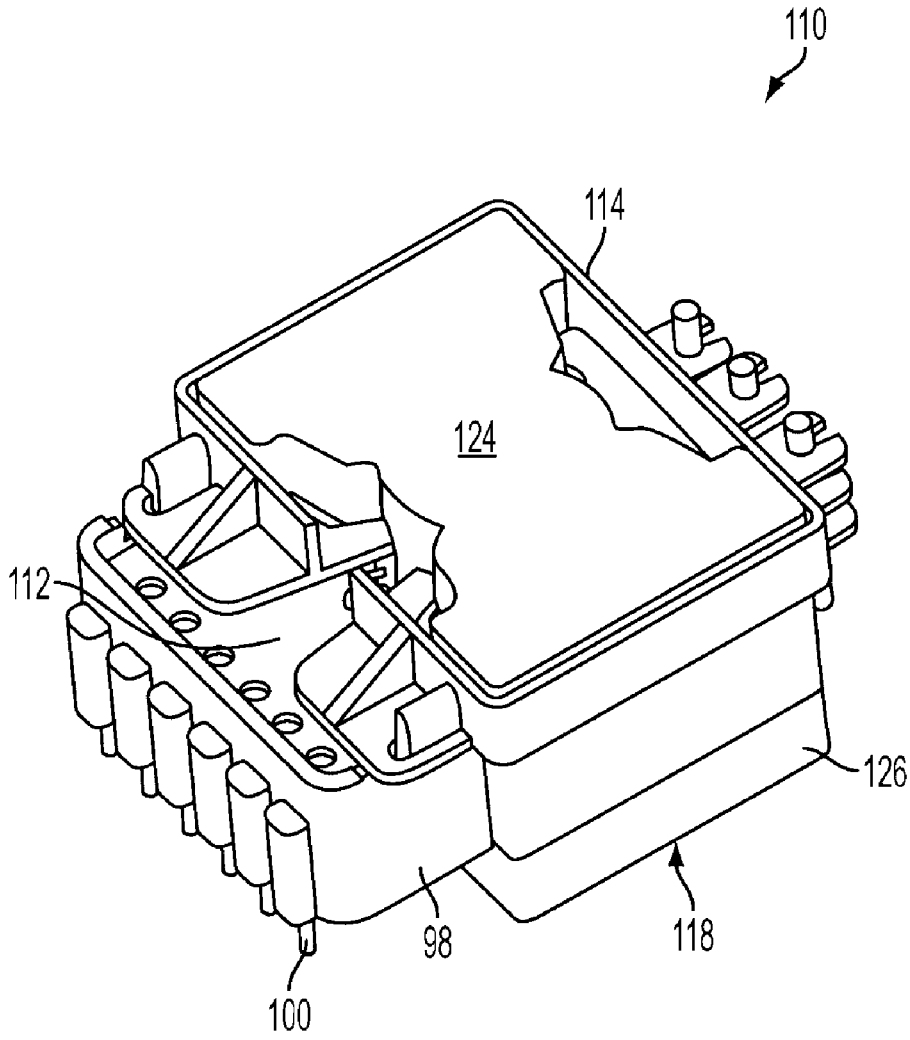
FIG. 13 illustrates various embodiments of a transformer.

FIG. 13 illustrates various embodiments of a transformer 110. The transformer 110 includes at least two conductor plates 112, a plate positioning member 114, an insulated wire 116, and a magnetic core 118. For purposes of clarity, the insulated wiring 116 is not shown in FIG. 13.

Figure 14:
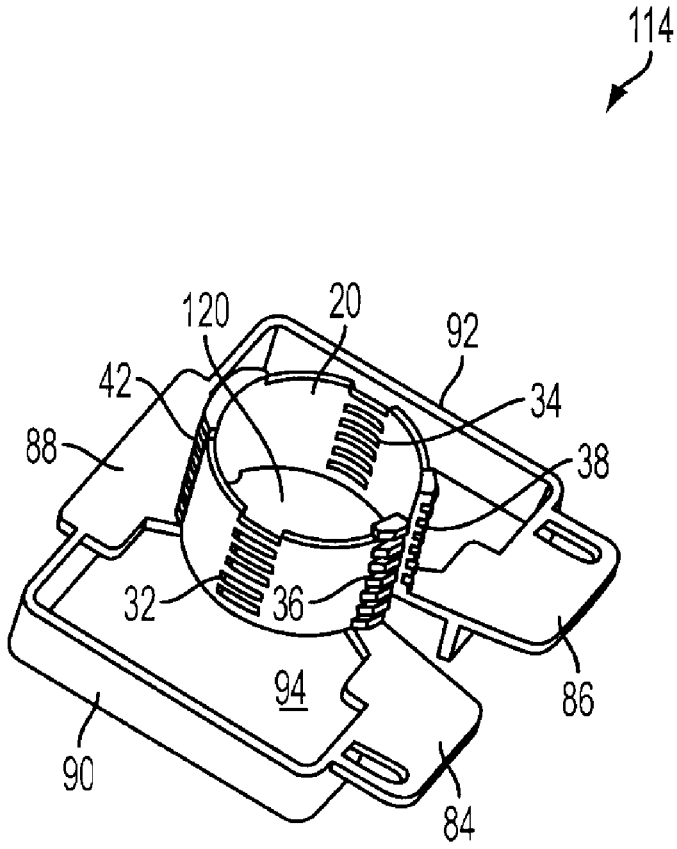
FIG. 14 illustrates various embodiments of a plate positioning member.

FIG. 14 illustrates various embodiments of the plate positioning member 114. The plate positioning member 114 is similar to the plate positioning member 82, but the wall 20 of the plate positioning member 114 defines a generally circular-shaped opening 120 sized to receive a portion of the magnetic core 118 therethrough. As shown in FIG. 14, the wall 20 may define a plurality of first slits 32 and a plurality of second slits 34 as described hereinabove. The wall 20 may also define a plurality of first grooves 36, a plurality of second groove 38, and a plurality of third grooves 42 as described hereinabove.

Figure 15:
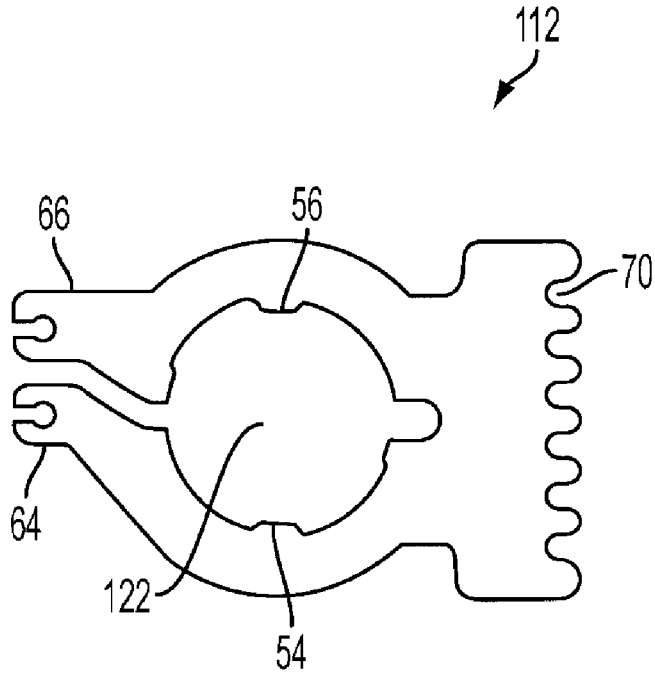
FIG. 15 illustrates various embodiments of a conductor plate.

FIG. 15 illustrates various embodiments of the conductor plates 112 of the transformer 110 of FIG. 13. The conductor plates 112 serve the same function as the conductor plates 12 described hereinabove, but have a different overall shape. Each conductor plate 112 defines a generally circular-shaped opening 122 that is sized to surround the plate positioning member 114 when the conductor plates 112 are connected to the plate positioning member 114. As shown in FIG. 15, the conductor plate 112 may also define a first tab 54 and a second tab 56 as described hereinabove.

The magnetic core 118, as shown in FIG. 13, serves the same function as the magnetic core 18 described hereinabove, but has a different overall shape. The magnetic core 118 but comprises a first generally E-shaped magnetic core 124 and a second generally E-shaped magnetic core 126. The first generally E-shaped magnetic core 124 includes a generally circular-shaped center leg and the second generally E-shaped magnetic core 126 includes a generally circular-shaped center leg. The generally circular-shaped center legs of the first and second generally E-shaped magnetic cores 124, 126 are surrounded by the plate positioning member 114, the conductor plates 112, and the insulated wire 116.

Figure 16:
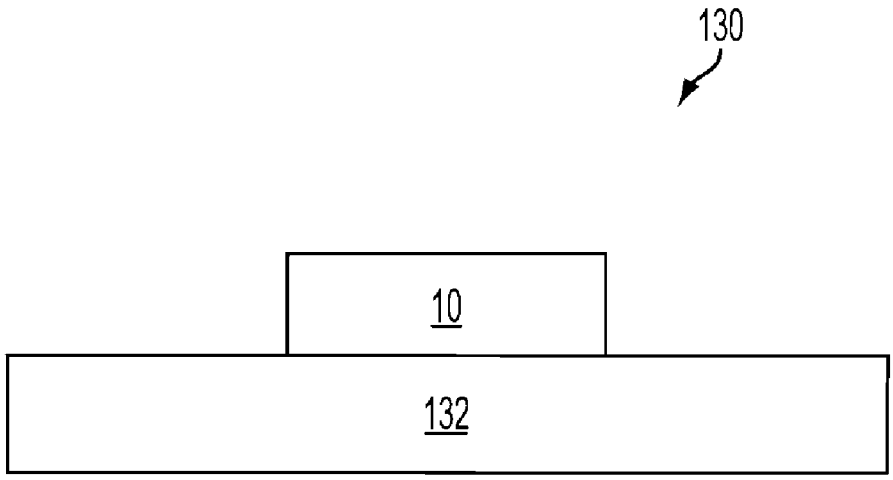
FIGS. 16-18 illustrate various embodiments of an electrical device.

FIG. 16 illustrates various embodiments of an electrical device 130. The device 130 includes the transformer 10 and a printed circuit board 132 that the transformer 10 is connected to. The transformer 10 may be connected to the printed circuit board 132 via the terminal pins of a terminal header that comprises a portion of the transformer 10. According to various embodiments, the device 130 may be a converter or a power supply.

Figure 17:
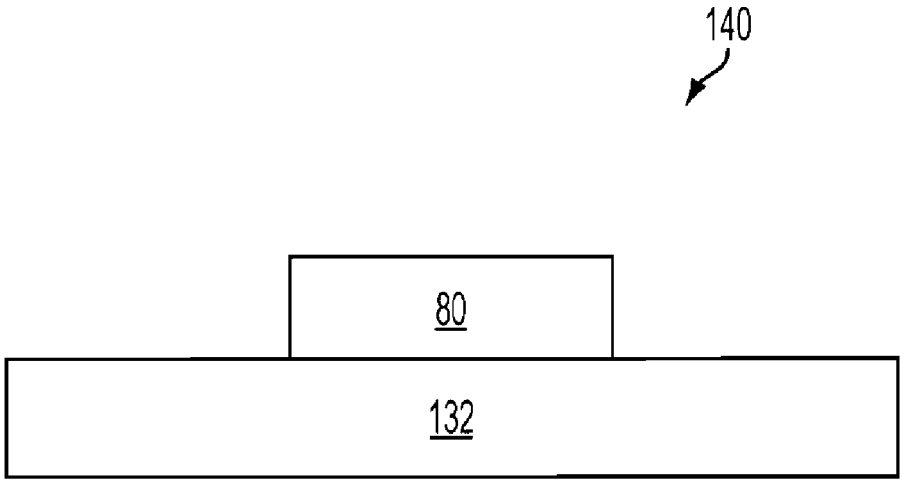

FIG. 17 illustrates various embodiments of an electrical device 140. The device 130 includes the transformer 80 and the printed circuit board 132. The transformer 80 is connected to the printed circuit board 132 via the terminal pins 100 of the terminal header 98. According to various embodiments, the device 140 may be a converter or a power supply.

Figure 18:
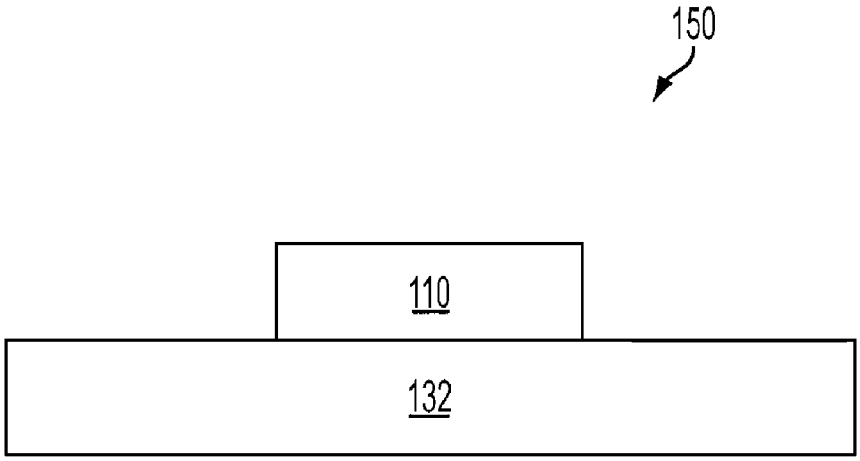

FIG. 18 illustrates various embodiments of an electrical device 150. The device 150 includes the transformer 110 and the printed circuit board 132. The transformer 110 is connected to the printed circuit board 132 via the terminal pins 100 of the terminal header 98. According to various embodiments, the device 150 may be a converter or a power supply.

By eliminating certain insulating barriers and spacings in the transformer coil, the various embodiments described hereinabove are able to meet the creepage distances, clearance spacings and safety insulation requirements set forth in various safety standards while minimizing the coil size, the safety insulation and the low leakage inductance of the transformer.

While several embodiments of the invention have been described, it should be apparent, however, that various modifications, alterations and adaptations to those embodiments may occur to persons skilled in the art with the attainment of some or all of the advantages of the disclosed invention. For example, although the respective conductor plates are illustrated as defining a generally rectangular-shaped opening 52 or a generally circular-shaped opening 122, it is understood that the conductor plates may define an opening of any suitable shape (e.g., square, oval, torroidal, etc.) that is compatible with the shape of the plate positioning member. Although the respective plate positioning members are shown as a generally rectangular tube or a generally cylindrical tube, it is understood that the plate positioning member may be fabricated in any shape that is compatible with the center leg of the magnetic core. Also, although the wall 20 of each respective plate positioning member is shown as defining a spacing 40, it is understood that, according to other embodiments, the wall 20 may be fabricated from a more resilient material and without such a spacing 40.

In addition, according to various embodiments, the first and/or second slits 32, 34 may be eliminated from the respective conductor plates, the shape and location of the various indents defined by the respective conductor plates may be altered, and the respective plate positioning members may define additional grooves at additional locations. According to various embodiments, the respective conductor plates may be connected to the plate positioning member by screws, adhesive, insert molding, etc. This application is therefore intended to cover all such modifications, alterations and adaptations without departing from the scope and spirit of the disclosed invention as defined by the appended claims.

What is claimed is:

1. A transformer, comprising:

a first conductor plate;

a second conductor plate spaced apart from and electrically connected to the first conductor plate;

a plate positioning member in contact with and surrounded by the first and second conductor plates;

an insulated wire wound around the plate positioning member and between the first and second conductor plates, wherein the insulated wire is in contact with the first and second conductive plates; and a magnetic core having a portion surrounded by the plate positioning member, the first conductor plate, the second conductor plate, and the insulated wire.

2. The transformer of claim 1, wherein the plate positioning member is fabricated from an insulating material.

3. The transformer of claim 1, wherein the plate positioning member is compressible.

4. The transformer of claim 1, wherein the plate positioning member defines a slit sized to receive a portion of at least one of the first and second conductive plates.

5. The transformer of claim 1, wherein the plate positioning member defines a groove sized to receive a portion of at least one of the first and second conductive plates.

6. The transformer of claim 1, wherein the plate positioning member defines:

an opening sized to receive the portion of the magnetic core;

a slit sized to receive a first portion of at least one of the first and second conductor plates; and a slot sized to receive a second portion of at least one of the first and second conductor plates.

7. The transformer of claim 1, wherein the first and second conductive plates form at least a portion of a secondary winding of the transformer.

8. The transformer of claim 1, wherein the first and second conductive plates are connected in series.

9. The transformer of claim 1, wherein the first and second conductive plates are connected in parallel.

10. The transformer of claim 1, wherein at least one of the first and second conductor plates define an opening that surrounds the plate positioning member.

11. The transformer of claim 1, wherein at least one of the first and second conductor plates is engaged with at least one of the following:

a slit defined by the plate positioning member; and a groove defined by the plate positioning member.

12. The transformer of claim 1, wherein at least one of the first and second conductor plates define a tab engaged with a slit defined by the plate positioning member.

13. The transformer of claim 1, wherein at least one of the first and second conductor plates define a tab engaged with a slot defined by the plate positioning member.

14. The transformer of claim 1, wherein the insulated wire includes at least two layers of insulation.

15. The transformer of claim 1, wherein the insulated wire forms at least a portion of a primary winding of the transformer.

16. The transformer of claim 1, further comprising a plurality of conductor plates electrically connected to the first and second conductor plates and having the insulated wire wound between each pair of adjacent conductor plates.

17. A transformer, comprising:

a plurality of electrically connected conductor plates;

a plate positioning member in contact with and surrounded by the plurality of conductor plates;

an insulated wire wound around the plate positioning member and between an adjacent pair of conductor plates, wherein the insulated wire is in contact with the adjacent pair of conductive plates; and a magnetic core having a portion surrounded by the plate positioning member, the plurality of conductor plates, and the insulated wire.

18. A transformer, comprising:

a first conductor plate;

a second conductor plate electrically connected to the first conductor plate;

a plate positioning member transitionable from a compressed state to an uncompressed state to retain the first and second conductor plates thereon such that a gap is defined between the first and second conductor plates;

an insulated wire wound around the plate positioning member and disposed in the gap between the first and second conductor plates; and a magnetic core disposed through an opening defined by the plate positioning member.

* * * * *